United States Patent [19]

Atterby et al.

[11] Patent Number: 4,831,938

[45] Date of Patent: May 23, 1989

[54] PALLET COMPRISING BASE MEMBERS AND CROSSWISE MEMBERS OR TUBES PERPENDICULARLY THERETO

[76] Inventors: Fred Atterby, Revviken, S-181 90 Lidingö ; Bertil Voss-Schrader, Korshamnsviken, S-139 00 Värmdö ; Lennart Tenggvist, Karlavägen 85, S-114 59 Stockholm, all of Sweden

[21] Appl. No.: 104,058

[22] PCT Filed: Jan. 19, 1987

[86] PCT No.: PCT/SE87/00021

§ 371 Date: Sep. 15, 1987

§ 102(e) Date: Sep. 15, 1987

[87] PCT Pub. No.: WO87/04408

PCT Pub. Date: Jul. 30, 1987

[30] Foreign Application Priority Data

Jan. 24, 1986 [SE] Sweden ..... 8600335

[51] Int. Cl.[4] ..... B65D 19/12

[52] U.S. Cl. ..... 108/51.3; 108/56.1

[58] Field of Search ..... 108/51.3, 56.3, 56.1, 108/51.1, 54.1, 64

[56] References Cited

U.S. PATENT DOCUMENTS

| | | | |
|---|---|---|---|
| 2,479,728 | 8/1949 | Darling | 108/51.3 |
| 2,576,715 | 11/1951 | Farrell | 108/51.3 |
| 2,609,136 | 9/1952 | Sider | 108/51.3 X |
| 2,728,545 | 12/1955 | Hermitage | 108/56.3 X |
| 2,783,011 | 2/1957 | Alexander | 108/51.3 |
| 2,789,685 | 7/1957 | Mooney | 108/51.3 |
| 3,000,603 | 9/1961 | Aemann | 108/51.3 |
| 3,256,839 | 6/1966 | Peterson et al. | 108/56.1 |
| 3,434,435 | 3/1969 | Achermann et al. | 108/51.3 |
| 3,654,877 | 4/1972 | Barrett . | |
| 3,683,822 | 8/1972 | Roberts et al. | 108/56.1 X |
| 3,881,429 | 5/1975 | Seymore | 108/56.3 X |

OTHER PUBLICATIONS

WO, 83/03238 (B. Voss-Schrader), Sep. 29, 1983, International Publication.

WO, 86/01786 (F. Atterby et al.), Mar. 27, 1986, International Publication.

*Primary Examiner*—Peter A. Aschenbrenner

*Attorney, Agent, or Firm*—Nies, Webner, Kurz & Bergert

[57] ABSTRACT

Pallet comprising base members (1–3) and crosswise members or tubes (4) perpendicularly thereto, especially a disposable pallet. According to the invention the pallet comprises base members (1–3) made by winding a web material coated with glue, the width of which suitably is equal to the length of the base member, around the first spindle, which preferably has a rectangular cross section, to the formation of an inner first bobbin (9). Subsequently a second spindle has been placed below the said first completed bobbin (9) and in contact with the lower surface thereof, the dimensions of the said second spindle being such that the same combined with the said first bobbin essentially completes the intended inner dimensions of the base member. The web material coated with glue on the surface has thereafter been wound around the structure formed by the said first bobbin (9) and the said second spindle to the formation of an outer second bobbin (10) whereupon the web has been cut and the spindles removed. Recesses (6) for the forks of a fork lift truck have then been made in the walls of the said second bobbin (10) and holes (8) for the said members (4) have been made through the two common opposite, vertical wall-sections of the first and the second bobbins.

11 Claims, 4 Drawing Sheets

PALLET COMPRISING BASE MEMBERS AND CROSSWISE MEMBERS OR TUBES PERPENDICULARLY THERETO

The present invention relates to a pallet comprising two or several base members provided with a number of holes at or at a minor distance from the upper load-bearing horizontal surfaces thereof, through which crosswise members or tubes are inserted under friction so as to unite the base members to the formation of the pallet. The tubes do not require specific fixation to the base members and are kept in position due to friction and the so-called "drawer effect"; the friction is considerably increased when the pallet is loaded.

The base members in the pallets according to the invention may, however, be united with each other by attaching a board of a suitable material (common board, plywood, etc.), e.g. by gluing, to the upper horizontal surfaces of the base members, in which case the above mentioned holes are not required or utilized. This board then forms the load-bearing plane. When tubes are used to unite the base members the load-bearing parts of the pallet comprise the upper parts of the tubes and the upper surfaces of the base members in combination. If desired or required in view of the dimensions of the goods to be transported the pallets may be provided with one board above the base members or several boards located between the same, which board or boards form a smooth and continuous load-bearing plane.

A pallet of the kind described above is the subject of WO . . . (PCT/SE 85/00346), which is incorporated herein as a reference.

The purpose of the said patent is to achieve a pallet which can be handled by forks from four sides, comprising at least two base members provided with holes near the upper load-bearing surfaces and with recesses in the lower parts, intended to receive the forks of a conventional fork lift truck, which pallet has a very low weight, is cheap, has a great flexibility as regards adaptability for different purposes, is not bulky when stored since it can be stored in the form of its separate parts. If desired, this pallet can be destroyed after use by burning without the formation of toxic or otherwise disturbing gases. This pallet can be handled and moved by a fork lift truck from all four sides; the forks can be inserted below the tubes from two sides and through the recesses in the base members from two sides, which is required for rational handling and storage of goods.

The base members for the pallets according to the present invention are in comparison with those previously known extremely cheap when manufactured in bulk and have a very low weight at a sufficient load-bearing capacity and fulfil all current requirements.

Accordingly, the present invention relates to a pallet comprising base members and, preferably, tubes perpendicularly thereto, especially a disposable pallet, characterized in that it comprises base members manufactured by winding a web material coated with a gluing substance, the width of said web material preferably being equal to the length of the base member, at first around a first spindle, preferably with a rectangular cross-section, the height of which corresponds to the diameter or height of the tubes and the width of which is adapted to the width intended for the base member, the number of turns giving the intended structural stability, to the formation of a first bobbin, whereupon a second spindle is placed below the said first bobbin and in contact with the lower surface of the said first bobbin, the dimensions of the said second spindle being such that the same together with the said first bobbin essentially completes the intended inner dimensions of the base member, whereupon the web material with a surface-coating of a gluing substance are wound around the structure formed by the said first bobbin and the said second spindle the number of turns required for the intended structural stability to the formation of a second bobbin enclosing the first bobbin, whereupon the web is cut and the spindles removed, and in that recesses for the forks of a fork lift truck are provided in the said second bobbin and holes for the said tubes are made through the common two opposite, vertical wall sections of the first and the second bobbin.

The invention is further elucidated below with reference to specific embodiments shown in the drawings, in which FIG. 1 in perspective shows a pallet according to the invention consisting of three base members and seven tubes;

FIG. 2 is an end view of a finished base member according to the invention;

FIG. 3 in perspective shows a ready-wound base member before the recesses for the forks of a fork lift truck and the holes for the tubes are made;

FIG. 4 in perspective shows the base member of FIG. 3 provided with Hshaped cuts for the recesses;

FIG. 5 in perspective shows an uncompleted folding of gluing tongues formed by the cuts shown in FIG. 4 at the left hand recess for forks;

FIG. 6 shows a cross section through a finished base member at a recess for forks in which the positions of the gluing tongues are shown. FIG. 6 also shows a stiff tensile-strong band running along the whole length of the base member and below the lower gluing tongues in the base member;

FIG. 7 a and b show end views in perspective of tubes wound on a spindle, with a circular cross section and with a square cross section;

Figure 1:
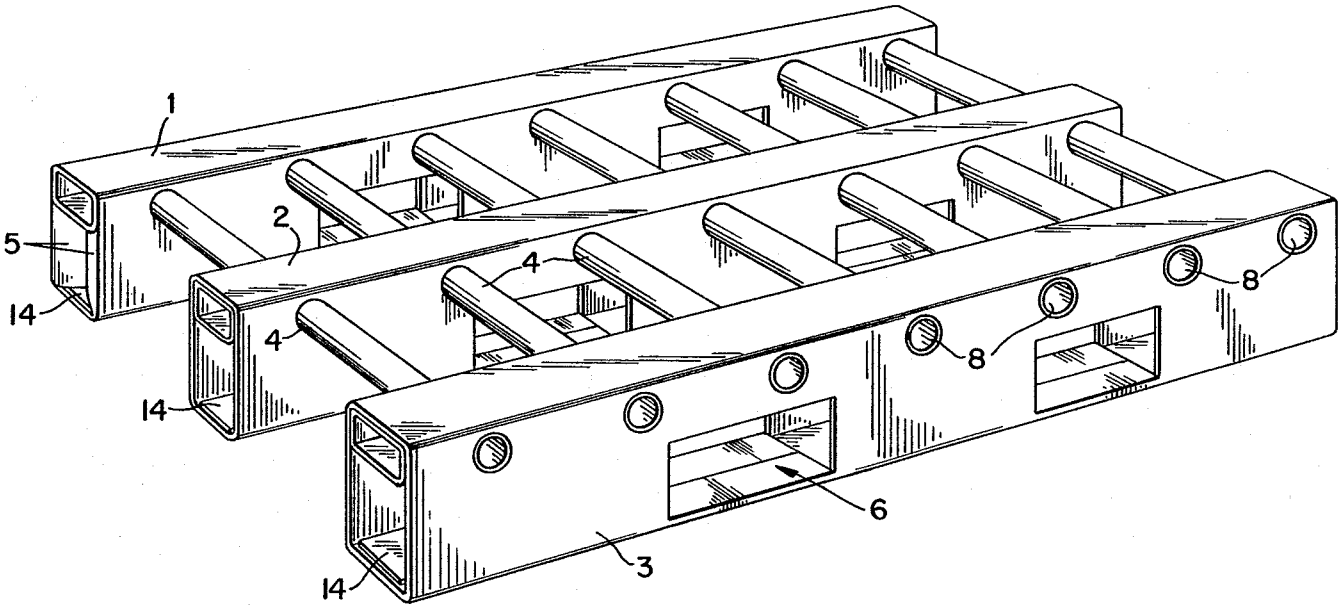

The base members and preferably also the tubes for the pallets according to the invention are made of a web material, preferably a fibrous material, such as carton or paper.

A preferred web material is polyethylene-coated carton, folding carton or a similar material with a thickness in the range of about 0.2 to 1.0 mm, especially about 0.3–0.5 mm, but the web material is in no way limited thereto. Alternative web materials are obvious to the expert. Such materials should be windable and gluable; they should preferably also have at least a certain degree of wet-strength.

A base member for the pallet according to the invention is manufactured as described below in more detail. The web material 16, 17 (see FIGS. 9 and 10) is wound around spindles 20, 22 in a manner known per se. The web material 16, which preferably has a width equal to the length of the base member, is provided with a coating of glue 18 at least on one side thereof and subsequently wound around a first spindle 20 (see FIG. 9), suitably with a rectangular cross section so as to form a first bobbin 9 (cf. FIG. 2) in the form of a tube with a rectangular cross section corresponding to that of the spindle 20. The inner height of the bobbin 9 and thus the height of the first spindle 20 preferably corresponds to the outer diameter or height of the tubes 4 intended for connecting the base members 1,2 and 3 with each other. The external width of the bobbin 9 is adapted to the desired inner width of the base member. The number of turns wound in the bobbin 9 is adapted to the intended or desired structural rigidity of the base member.

Figure 9:
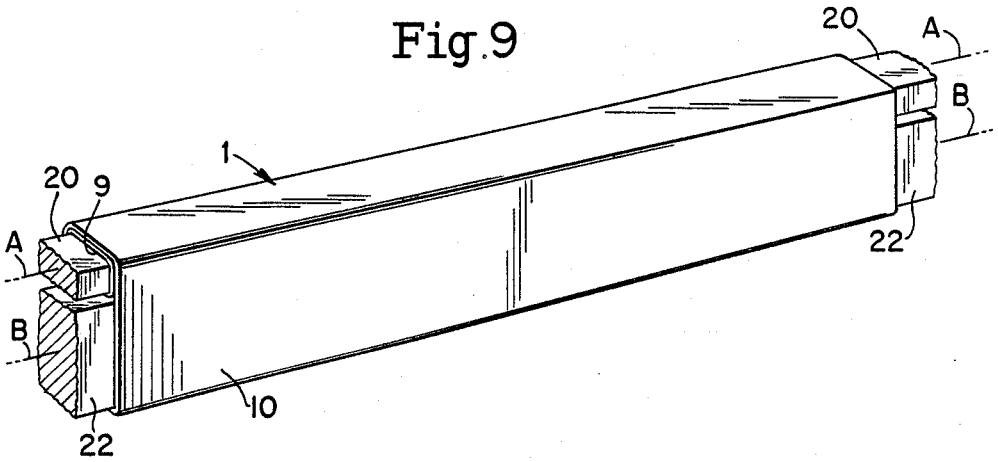
FIG. 9 is a perspective view of a base member similar to FIG. 3 with the spindles about which the two bobbin parts are wound shown diagrammatically.
Figure 10:
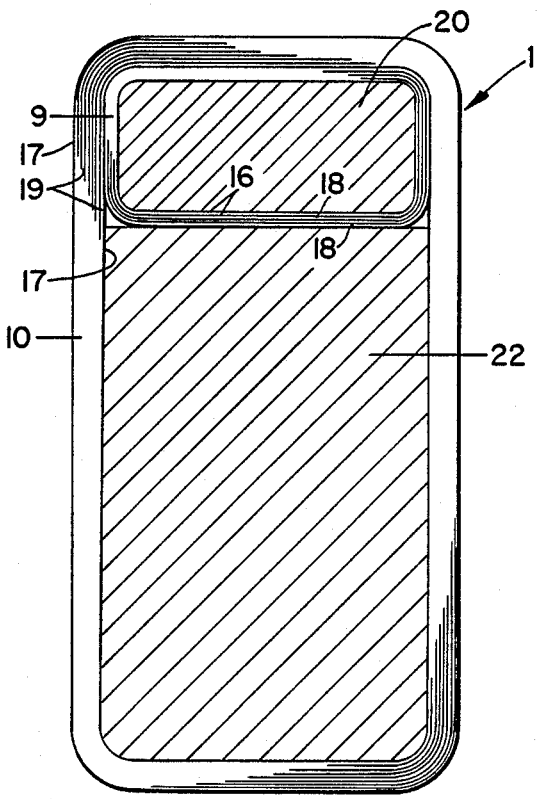
FIG. 10 a vertical cross-section through the beam and diagrammatical spindles of FIG. 9 before the spindles are removed.

Subsequently a second spindle 22 (see FIGS. 9 and 10), with its axis B parallel with the axis A of spindle 20, is placed in contact with the completed first bobbin 9 at the lower surface thereof, cf. FIG. 2. The dimensions of the second spindle 22 are such that it together with the first bobbin 9 essentially completes the inner cross-section dimensions of the base member. As seen in FIGS. 9 and 10, a second bobbin 10 is then wound from the web material 17, which, as was done with web 16, is provided with a coating of glue 19 at least on one side, around the structure formed by the second spindle 22 and the first bobbin 9. The number of turns wound in the second bobbin 10 is adapted to the required or intended structural rigidity of the base member.

It is thus obvious that the first bobbin 9 and the second bobbin 10, which tightly encloses the first bobbin along three of its surfaces, are parallel and together form a united laminated structure of a great strength. After winding the two bobbins 9 and 10 is completed into the laminated base member 1, the two spindles are removed.

Recesses 6 for the forks of a fork lift truck are then made in the said second bobbin 10. Holes 8 for the tubes 4 are also made through the common opposite vertical wall sections of the bobbins 9 and 10.

The first bobbin 9 contains usually so many turns of the web material that its wall thickness is within the range 2–4 mm, whereas the second bobbin 10 usually contains so many turns that its wall thickness is within the range 3–5 mm. Greater thicknesses are often required for havier loads.

When the above mentioned preferred web material is used the first bobbin 9 contains 4–8 turns and the second bobbin 10 contains 6–12 turns as is noted on the legends of FIG. 10.

Figure 6:
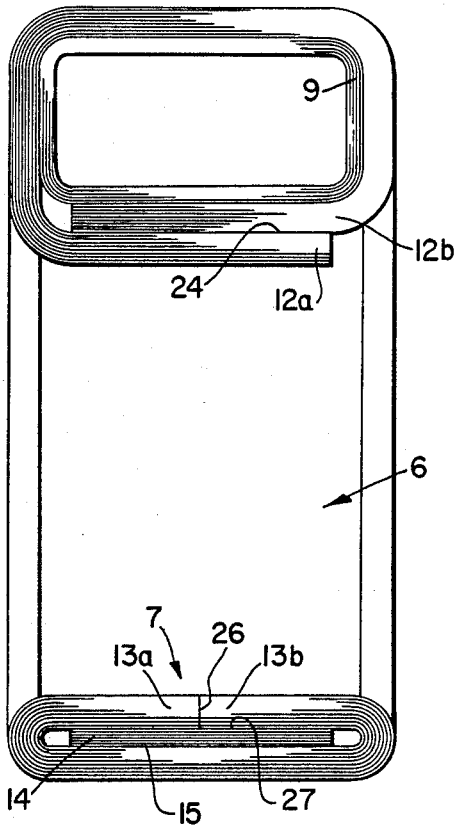
Figure 7A:
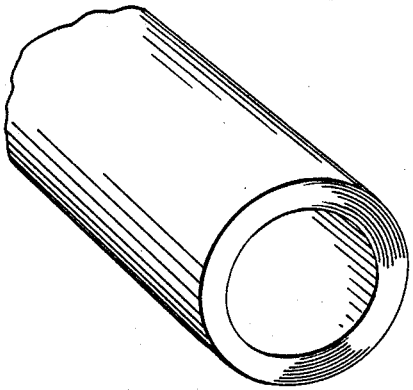
Figure 7B:
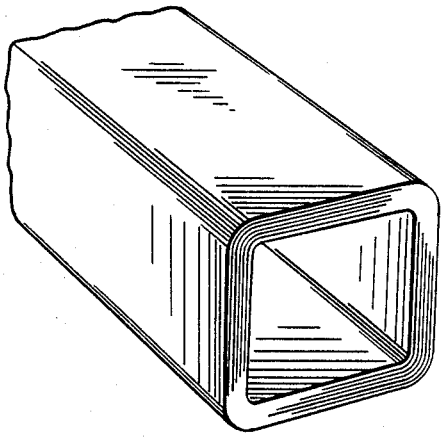

According to a preferred embodiment the recesses 6 for the forks of a fork lift truck are formed by making essentially H-shaped cuts 11 (FIG. 4) at the positions for the recesses, whereupon the pairs of gluing tongues 12*a*, 12*b*; 13*a*, 13*b* (FIGS. 4 and 5) are folded inwards and glued to each other (at 24 and 26, respectively (see FIG. 6). In this way two rectangular recesses 6 (FIG. 1) for the forks are obtained in the base members 1,2 and 3, in which recesses 6 the upper pair of gluing tongues 12*a* and 12*b* form a "roof" in the recess 6 through the base member and a second lower pair of gluing tongues 13*a* and 13*b* form a band girder 7 (FIG. 6) essentially level with the lower surface of the base member, which girder 7 forms the bottom surface of the recess 6.

Figure 3:
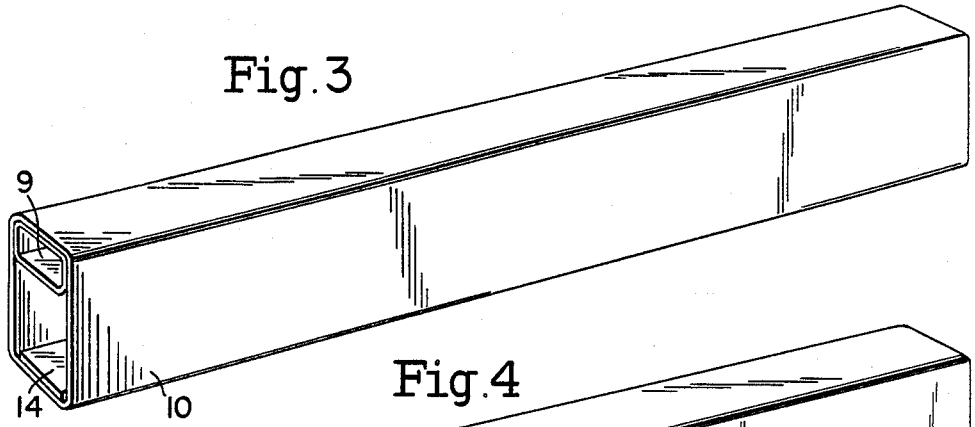
Figure 4:
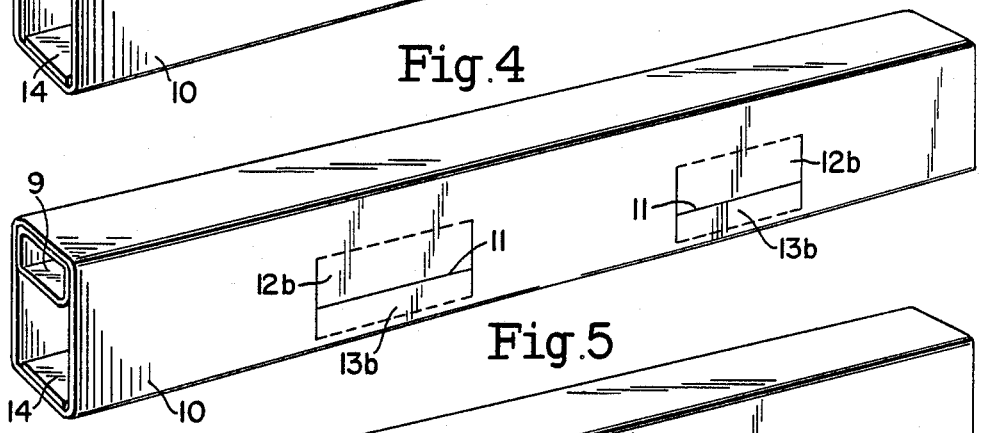

FIG. 3 shows a base member before the H-shaped cuts are made in the second bobbin 10, i.e. in the ready-wound state except for the band girder 14 which is shown attached to the inner lower surface. In FIG. 4 the H-shaped cuts 11 are indicated by continuous lines, whereas the dotted lines indicate the folding lines for the gluing tongues 12*b* and 13*b*.

Figure 5:
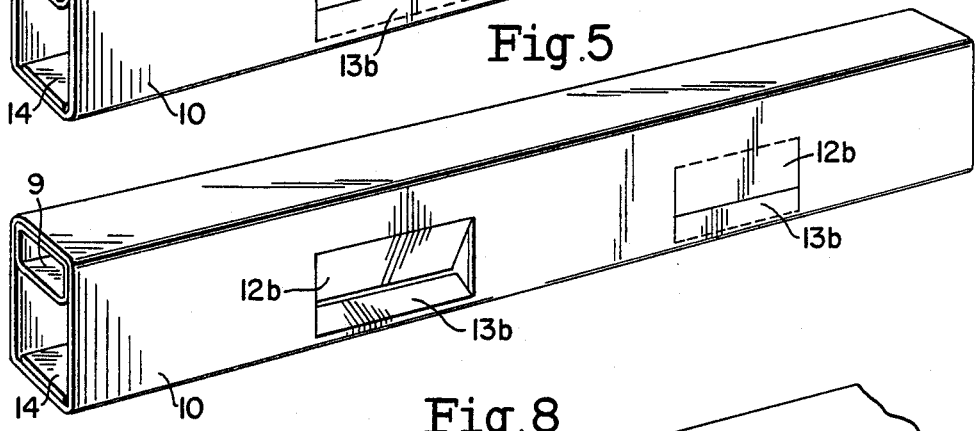

FIG. 5 shows an uncompleted folding of gluing tongues 12*b*,13*b* at the left hand recess 6 in FIG. 5.

Figure 2:
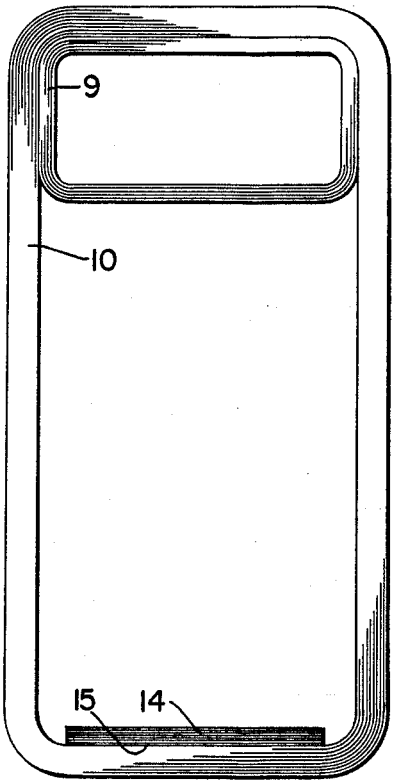

FIGS. 1, 2 and 6 show the finished base members in perspective end view and cross section at the recess resp.

The tubes 4 which connect the base members can be wound in the same manner as the base members with the use of the same web material and may in relation to the desired strength contain 5–10 turns of the web material or more. The tubes may have any cross section such as a circular or a rectangular one.

It is, of course, also possible to use any type of conventional tubes or similar means of any cross section and any kind of material for connecting the base members with each other.

The spindles used for making the bobbins 9 and 10 (as well as the one used for making the tubes) are suitably in a conventional manner expandable so as to facilitate the removal of the same when the winding is completed.

The holes for the tubes 4 and the H-shaped cuts can be made in different ways, e.g. by pressing, cutting or with a circular saw. The cutting can also be made with a water jet under a very high pressure.

Figure 8:
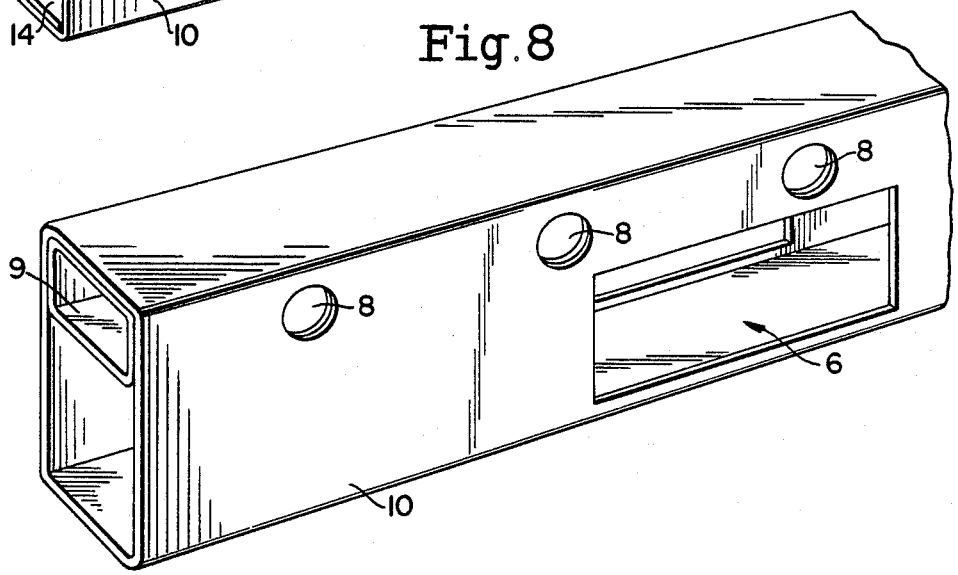
FIG. 8 shows in perspective an alternative embodiment of the base members in which rectangular holes have been made for the recesses without leaving folding tongues.

According to another embodiment the above mentioned H-shaped cuts are not made, and then the recesses 6 are cut out from the walls of the second bobbin 10 as shown in FIG. 8 without the formation of gluing tongues. This embodiment is primarily suitable for pallets intended for light loads. It is obvious that the last-mentioned embodiment is somewhat cheaper to manufacture than the firstmentioned one.

Also according to this second embodiment, however, a greater number of wound turns can compensate for the omitted gluing tongues 12*a*,12*b*, 13*a* and 13*b* and the strength they give.

So as to further stiffen the base members 1,2,3 the length of the base members can be somewhat increased above that intended for the finished base member which makes it possible to cut out folding tongues 5 (FIG. 1) which are to be folded into the end spaces of base members as shown in FIG. 1.

For increasing the strength of the base members 1,2,3 a preferably stiff tensile-strong band 14 of the same or a similar material as the one used for the base members can be glued at 15 (FIGS. 2 and 6) along the inner, lower, horizontal surface of the second bobbin 10 and along the whole length of the base members 1,2,3 as shown in FIGS. 2 and 6. The width of this band 14 is suitably about equal to inner width of the base members.

When the H-shaped cuts have been made in a base member according to FIG. 2 the gluing tongues 13*a*,13*b* are folded inwards and glued to each other by glue 26 and preferably also to the band 14 with glue 27 and the girder 7 will then obtain the configuration shown in FIG. 6.

The dimensions of the pallet according to the invention can be varied within wide limits. For commercial reasons the length of the base members is usually adapted to current standards, i.e. 1.2 meters and the tubes are then correspondingly 0.8 meters (Eurostandard). These dimensions may also be switched. The current standard requires a height of the recesses above the floor of about 9 cm. The width of the base members may be varied extensively in relation to the intended load-bearing capacity; the said width is, however, usually within the range 5–10 cm. The crosswise members or tubes have preferably an outer diameter of about 40–50 mm, since this range has been shown to give maximum rigidity for a given amount of material.

Suitable glue products, which admit a rapid gluing, are commersially available. Thermoplastic glues may be used, e.g. in the emulsion form, optionally boosted by a chelate former, or glues of the hot-melt type.

The lower surfaces of the base members, which rest against the floor or ground, can be provided with a more wear-resistant surface coating, if required. Such a coating may be made with the use of many different materials such as extra layers of the laminate used for the base members or a thicker layer of polyethylene attached thereto by heat-melting or similar.

The invention has been described above with reference to specific embodiments. It is obvious that modifications of the described base members may be made without deviating from the inventive principle. Such modifications are obvious to the expert on the basis of the guidance and description given above and in the enclosed drawings.

The invention is thus not delimited to the specific embodiments in question but can be varied extensively within the scope of the patent claims.

We claim:

1. Pallet comprising elongate hollow tubular base members (1–3) having a predetermined length, height and width; and crosswise members (4), having a predetermined length, disposed perpendicularly to said base members, characterized in that each said base member comprises and is constructed from a web material and a surface-coating of glue on the web material, the width of said web material being a dimension substantially equal to the length of the base members, said web material, with said surface coating of glue, being wound in multiple layers around a removable first spindle, with a rectangular cross section to form a first elongate part, a bobbin (9) of said base member, the height of said first part corresponding substantially to the height of the crosswise members (4), and the width of the first part being essentially the width of a said base member, the layers of said wound material being made with a sufficient number of layers so the multiple layers of web material and glue provides the desired structural strength, and has the shape of said first bobbin (9), and in that subsequently a second removable spindle is disposed parallel and in contact with the lower surface of said first bobbin (9), the dimensions of the second removable spindle being such that it, together with said first bobbin (9) essentially comprises the inner dimensions of a base member's cross-section, and in that additional said web material with additional said surface-coating of glue is wound around the structure formed by said first bobbin (9) and the second spindle a desired number of turns so the number of layers of web material and glue constitutes a second elongate part, a second bobbin (10), of a said base member having the desired shape and structural strength of a said base member constructed with the second bobbin (10) being parallel with and enclosing the said first bobbin (9), whereupon the removable spindles are removed; and in that, means are provided between the top and bottom of the pallet to enable projection and disposition of the forks of a fork lift truck to a position under pallet structure to thereby enable lifting of the pallet by the forklift truck.

2. Pallet according to claim 1, characterized in that the said recesses (6) have been made by cutting essentially H-shaped pairs of cuts (11) at the positions for the recesses for the forks of a fork lift truck, whereupon gluing tongues (12*a*,b and 13*a,b*) formed thereby are folded inwards and glued to each other.

3. Pallet according to claim 2, characterized in that the base members therein (1,2,3) on the lower internal surfaces thereof have been provided with a girder band (14) of a stiff, tensile-strong material glued thereto, which band runs below the gluing tongues (13*a*,13*b*) along the whole length of the base members, the width of said band suitably being equal to the inner width of the base members.

4. Pallet according to claim 1, characterized in that the pallet parts are made of a web material with a thickness within the range 0.2–1.0 mm, especially 0.3–0.5 mm.

5. Pallet according to claim 1, characterized in that the web material comprises polyethylene-coated carton, folding carton, paper or a similar fibrous material.

6. Pallet according to claim 2, characterized in that the glue applied on the surface of the web material and used for gluing the tongues (12*a*,12*b*;13*a*,13*b*) is a thermoplastic glue, such as an emulsion glue, optionally boosted with a chelate former.

7. Pallet according to claim 1, characterized in that the said bobbin (9) contains 4–8 layers of a carton material with a thickness in the range 0.3–0.5 mm and that the second bobbin (10) contains 6–12 layers.

8. Pallet according to claim 1, characterized in that it comprises crosswise members which are tubes (4) made by winding the said web material around a spindle.

9. A pallet as defined in claim 1 wherein said second bobbin (10) has side walls projected below said first bobbin (9) and that the means between the top and bottom of the pallet to enable disposition of the forks of a fork lift truck to enable lifting of the pallet comprises recesses (6) for the forks of a fork lift truck made in the side walls of said second bobbin (10) and located below said first bobbin (9).

10. A pallet as defined in claim 1, wherein said crosswise members (4) are elongate members said second bobbin (10) and said first bobbin (9) have common, united, laterally spaced apart vertical side walls; and holes (8) are provided, for said elongate crosswise members, through the two spaced-apart, vertical wall sections of the first (9) and the second (10) bobbin.

11. A pallet as defined in claim 10, wherein said crosswise members are elongate tubes.

* * * * *

UNITED STATES PATENT AND TRADEMARK OFFICE

CERTIFICATE OF CORRECTION

PATENT NO. : 4,831,938

DATED : May 23, 1989

INVENTOR(S) : FRED ATTERBY et al.

It is certified that error appears in the above-identified patent and that said Letters Patent is hereby corrected as shown below:

ON THE COVER SHEET

At the upper part of column 1 where the names of the inventors appear, the spelling of the last name of the third inventor should be corrected to read

--TENGQVIST--

Signed and Sealed this

Twentieth Day of February, 1990

*Attest:*

JEFFREY M. SAMUELS

*Attesting Officer*

*Acting Commissioner of Patents and Trademarks*